US011137701B2

(12) United States Patent
Lee et al.

(10) Patent No.: US 11,137,701 B2
(45) **Date of Patent: *Oct. 5, 2021**

(54) FUSING APPARATUS AND IMAGE FORMING APPARATUS INCLUDING THE SAME

(71) Applicant: HEWLETT-PACKARD DEVELOPMENT COMPANY, L.P., Spring, TX (US)

(72) Inventors: Sun-hyung Lee, Yongin-si (KR); Sung-woo Kang, Suwon-si (KR); Ji-su Park, Suwon-si (KR); Sea-chul Bae, Seoul (KR); Gil-jae You, Suwon-si (KR); Seung-jun Lee, Suwon-si (KR); Young-hoon Han, Suwon-si (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/033,148

(22) Filed: Sep. 25, 2020

(65) Prior Publication Data

US 2021/0011398 A1 Jan. 14, 2021

Related U.S. Application Data

(63) Continuation of application No. 16/709,274, filed on Dec. 10, 2019, now Pat. No. 10,831,135, which is a (Continued)

(30) Foreign Application Priority Data

Mar. 31, 2017 (KR) ..... 10-2017-0041711

(51) Int. Cl.
*G03G 15/20* (2006.01)
*G03G 21/16* (2006.01)

(52) U.S. Cl.
CPC ..... *G03G 15/2028* (2013.01); *G03G 21/1647* (2013.01); *G03G 21/1685* (2013.01)

(58) Field of Classification Search
CPC ..... G03G 15/2028; G03G 21/1647; G03G 21/1685; G03G 15/2053; G03G 2215/2022; G03G 2215/2025
See application file for complete search history.

(56) References Cited

U.S. PATENT DOCUMENTS 8,886,101 B2 11/2014 Kawata et al.
9,164,445 B2 10/2015 Shimokawa et al.
(Continued)

FOREIGN PATENT DOCUMENTS

CN 102540830 7/2012
JP 2001034100 A 2/2001
(Continued)

*Primary Examiner* — Sandra Brase
(74) *Attorney, Agent, or Firm* — Staas & Halsey LLP

(57) ABSTRACT

A fusing apparatus for an image forming apparatus includes a fusing belt having a sidewall that faces the fusing bel, a guide member, disposed on the sidewall and having a lower portion disposed above a lower portion of the bushing, and a ring member, disposed between the guide member and the fusing belt. The ring member can be deflected toward the sidewall in a gap which is provided below the lower portion of the guide member and between the ring member and the sidewall.

19 Claims, 26 Drawing Sheets

Related U.S. Application Data continuation of application No. 16/138,467, filed on Sep. 21, 2018, now Pat. No. 10,551,775, which is a continuation of application No. 15/646,534, filed on Jul. 11, 2017, now Pat. No. 10,120,310.

(56) References Cited

U.S. PATENT DOCUMENTS

| | | | | |
|---|---|---|---|---|
| 10,120,310 | B2 | 11/2018 | Lee et al. | |
| 10,831,135 | B2 * | 11/2020 | Lee | G03G 21/1685 |
| 2007/0014602 | A1 | 1/2007 | Seol | |
| 2009/0245843 | A1 | 10/2009 | Sato | |
| 2013/0164056 | A1 | 6/2013 | Imada et al. | |
| 2013/0177340 | A1 | 7/2013 | Kawata et al. | |
| 2013/0183071 | A1 | 7/2013 | Iwaya et al. | |
| 2013/0195525 | A1 | 8/2013 | Yoshinaga et al. | |
| 2013/0209119 | A1 | 8/2013 | Yuasa et al. | |
| 2013/0209146 | A1 | 8/2013 | Yamaji et al. | |
| 2013/0308990 | A1 | 11/2013 | Samei et al. | |
| 2016/0327893 | A1 | 11/2016 | Kim et al. | |
| 2016/0363896 | A1 | 12/2016 | Hayashi | |

FOREIGN PATENT DOCUMENTS

| | | | |
|---|---|---|---|
| JP | 2005-156918 | | 6/2005 |
| JP | 2015038550 | A | 2/2015 |
| JP | 2015161851 | A | 9/2015 |
| JP | 2016110020 | A | 6/2016 |
| JP | 2017015808 | A | 1/2017 |

* cited by examiner

FUSING APPARATUS AND IMAGE FORMING APPARATUS INCLUDING THE SAME

CROSS-REFERENCE TO RELATED APPLICATIONS

This application is a continuation application of U.S. patent application Ser. No. 16/709,274, filed on Dec. 10, 2019, which is currently pending and which is a continuation application of U.S. patent application Ser. No. 16/138,467, filed on Sep. 21, 2018, which issued as U.S. Pat. No. 10,551,775 on Feb. 4, 2020, and which is a continuation application of U.S. patent application Ser. No. 15/646,534, filed on Jul. 11, 2017, which issued as U.S. Pat. No. 10,120,310 on Nov. 6, 2018, and which claims priority from Korean Patent Application No. 10-2017-0041711, filed on Mar. 31, 2017, in the Korean Intellectual Property Office. The disclosures of each of all of the above-identified applications are incorporated herein by reference in their entirety.

BACKGROUND

Apparatuses described in the disclosure relate to a fusing apparatus and an image forming apparatus including the same, and more particularly, to a fusing apparatus in which damage to a fusing belt due to meandering of the fusing belt may be prevented, and an image forming apparatus including the same.

Generally, an image forming apparatus includes a fusing apparatus heating and pressing a recording medium (a paper) to fuse toner images contained in the recording medium to the recording medium. In the fusing apparatus, a pressing member disposed at an inner circumferential side of a fusing belt is pressed to a pressing roller disposed at an outer circumferential side of the fusing belt to form a fusing nib part between the fusing belt and the pressing roller. The fusing apparatus heats the fusing belt by a heating source disposed inside the fusing belt to heat the recording medium passing through the fusing nib part.

The fusing belt is positioned between the pressing member positioned in the fusing belt and the pressing roller and rotates by mutual pressing between the pressing member and the pressing roller and the pressing roller that rotates, and a toner is fused to the recording medium while the recording medium and the toner pass between the fusing belt and the pressing roller. In such a process, rotation travel of the fusing belt is guided by a bushing for the purpose of smooth travel of the fusing belt.

DETAILED DESCRIPTION

To sufficiently understood configurations and effects of the disclosure, examples of the disclosure will be described with reference to the accompanying drawings. However, the disclosure is not limited to examples to be described below, but may be implemented in several forms and may be variously modified. A description for these examples will be provided to make the disclosure complete and allow those skilled in the art to which the disclosure pertains to completely recognize the scope of the disclosure. In the accompanying drawings, sizes of components may be enlarged as compared with actual sizes for convenience of explanation, and ratios of the respective components may be exaggerated or reduced.

Terms 'first', 'second', and the like, may be used to describe various components, but the components are not to be limited by the terms. These terms may be used to differentiate one component from other components. For example, a 'first' component may be called a 'second' component, and the 'second' component may also be called the 'first' component, without departing from the scope of the disclosure.

Singular forms are intended to include plural forms unless the context clearly indicates otherwise. It may be interpreted that terms "include", "have", or the like, specify the presence of features, numerals, steps, operations, components, parts mentioned in the specification, or a combination thereof, but do not preclude the addition of one or more other features, numerals, steps, operations, components, parts, or a combination thereof.

Terms used in examples of the disclosure may be interpreted as the same meanings as meanings that are generally known to those skilled in the art unless defined otherwise.

A case in which a fusing belt is applied with a force biased toward any one direction along an axis direction in a length direction of the fusing belt due to factors such as alignment balancing between the fusing belt and the pressing roller, a tolerance or an assembling gap between components, a deviation of a component pressing the bushing, a difference in an outer diameter between both ends of a fusing film in the length direction, an influence by introduction of the recording medium into the nib part and passing through the nib occurs.

The fusing belt rotation-traveled is biased toward any one side due to such a force, which is called meandering. An edge of the fusing belt is worn by a sidewall of the bushing due to such a force is thus damaged.

Figure 1:
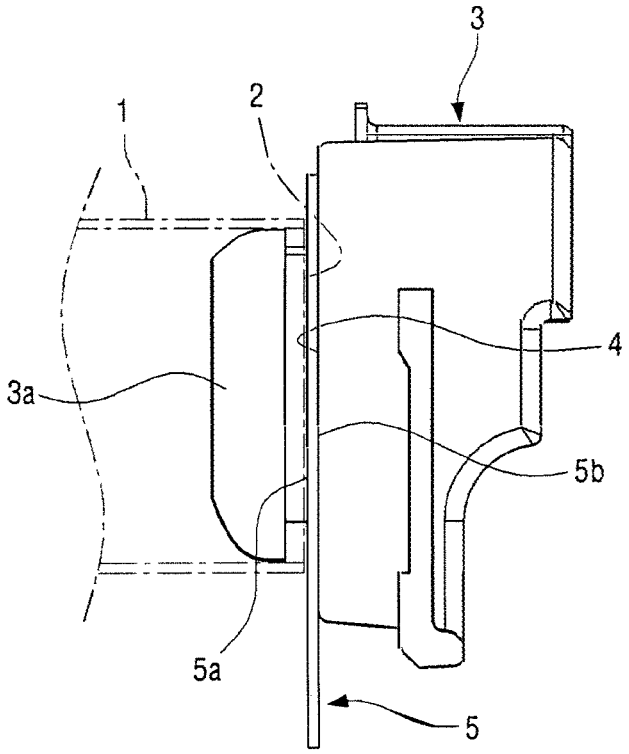
FIG. 1 is a schematic view illustrating an example in which a ring member is disposed on a bushing in a belt-type fusing apparatus according to the related art.

To prevent the edge of the fusing belt from being damaged, which is a chronic problem occurring in a fusing belt manner as described above, a ring member 5 having a thin thickness is disposed between a fusing belt 1 and a bushing 3, as illustrated in FIG. 1. In this case, a plurality of ring members may also be disposed.

One surface 5*a* of the ring member 5 is in contact with an edge 2 of the fusing belt at the time of meandering of the fusing belt 1, such that the ring member 5 sliding-rotates together with the fusing belt 1, thereby preventing the edge 2 of the fusing belt from being in direct contact with a sidewall 4 of the bushing 3. As described above, the ring member 5 suppresses the edge 2 of the fusing belt from being in contact with and being worn by the sidewall 4 of the bushing to prevent the fusing belt 1 from being damaged, such that a fusing apparatus stably rotated for a long period of time is provided.

Meanwhile, the ring member 5 sliding-rotates together with the fusing belt 1 by a frictional force generated between one surface 5*a* of the ring member and the edge 2 of the fusing belt. However, since a contact area between one surface 5*a* of the ring member and the edge 2 of the fusing belt is significantly smaller than that between the other surface 5*b* of the ring member and the sidewall 4 of the bushing, the frictional force generated between one surface 5*a* of the ring member and the edge 2 of the fusing belt is smaller than that between the other surface 5*b* of the ring member and the sidewall 4 of the bushing. Therefore, the ring member 5 does not smoothly sliding-rotate together with the fusing belt 1, such that a slip phenomenon is generated between the edge 2 of the fusing belt and one surface 5*a* of the ring member. Therefore, the ring member 5 does not perform its role.

Further, a case in which a liquid-phase or gel-phase lubricant applied to an inner portion of the fusing belt 1 flows out to the edge 2 of the fusing belt at the time of rotation of the fusing belt 1 to be thus applied to one surface 5*a* of the ring member 5 occurs. The slip phenomenon between the edge 2 of the fusing belt and the one surface 5*a* of the ring member is further intensified due to the lubricant, and a case in which the ring member 5 does not rotate together with the fusing belt 1 at all occurs.

In addition, in the fusing belt manner, the belt is positioned between the pressing member 9*a*, 9*b* and the pressing roller 8, and the fusing nib part is formed by mutual pressing between the pressing member and the pressing roller with the belt interposed therebetween. The fusing nib part in the fusing belt manner generally has a wide and flat shape.

Figure 2:
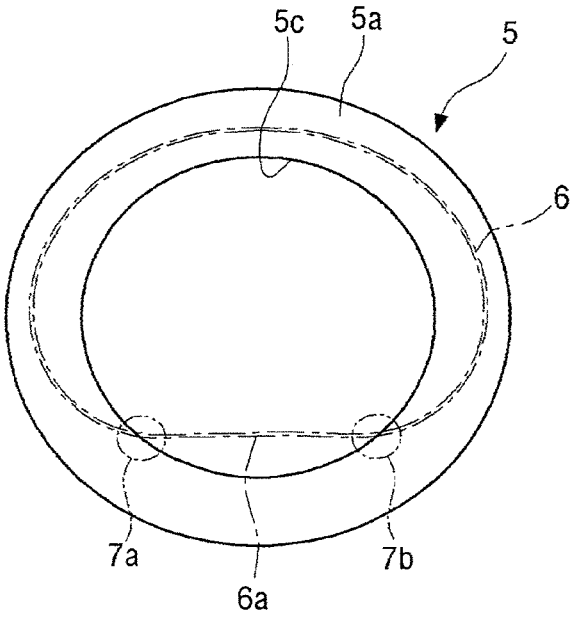
FIG. 2 is a schematic view illustrating portions of a rotation trajectory of a fusing belt intersecting with an inner circumference of the ring member.

The fusing belt 1 has an approximately circular shape, and considering characteristics (a relatively wider and flatter nib is formed as compared with a fusing roller manner) of the fusing nib part of the fusing belt 1, a flat section 6*a* having the same shape as that of the fusing nib part as illustrated in FIG. 2 is generated in a rotation trajectory 6 of the fusing belt. The flat section 6*a* has portions 7*a* and 7*b* intersecting with an inner circumferential end 5*c* of the ring member 5 at two places.

Figure 3:
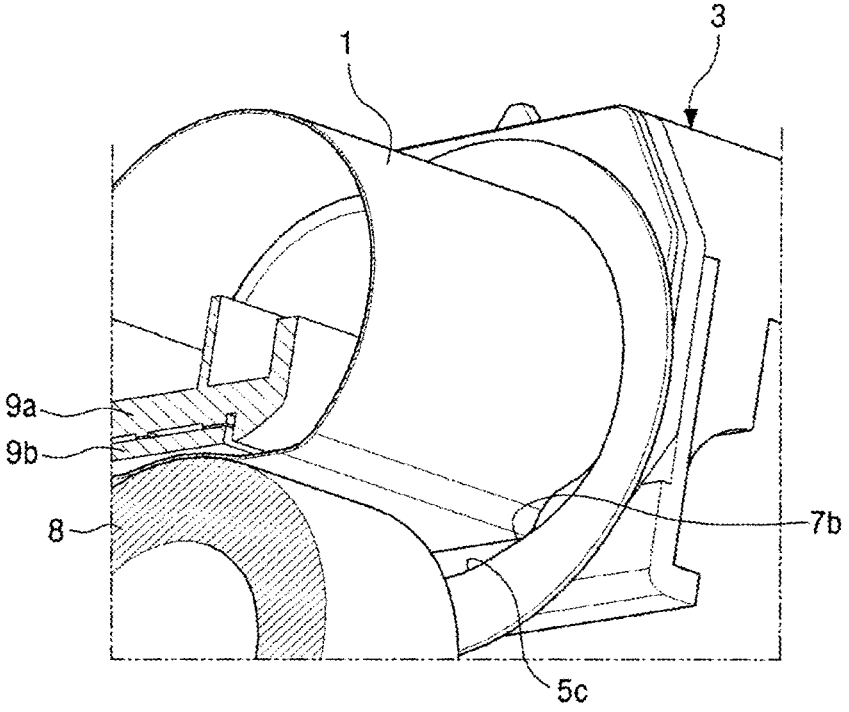
FIG. 3 is a schematic view illustrating an example in which the fusing belt goes into a coupling hole of the ring member while rotating.
Figure 4:
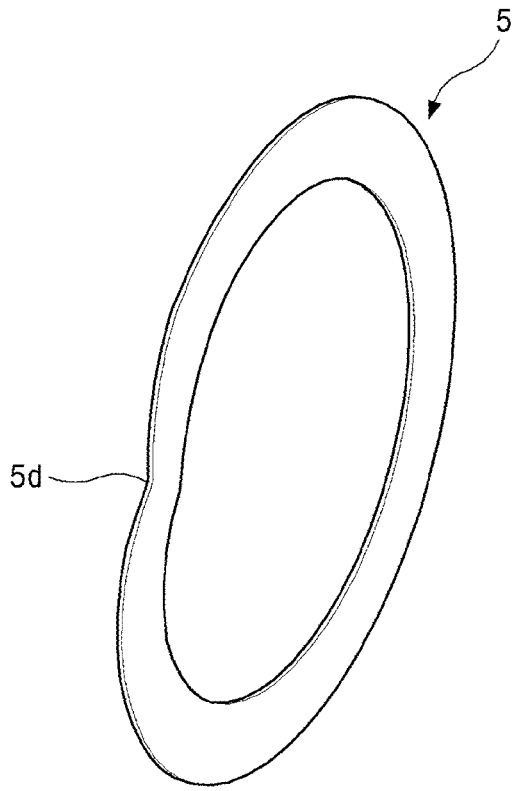
FIG. 4 is a perspective view illustrating the ring member of which a portion is bent by an edge of the fusing belt as in FIG. 3.

However, in the case in which the ring member 5 does not sliding-rotate together with the fusing belt 1 as described above, a portion of the fusing belt 1 is deformed while a large deformation force is generated in any one 7*b* of the intersecting portions, as illustrated in FIG. 3. In this case, the ring member 5 does not have a restoring force, such that an inflection portion 5*d* is formed in a surface of the ring member 5, as illustrated in FIG. 4.

In addition, due to the deformation of the fusing belt 1, an outer circumferential surface of the fusing belt 1 goes into a hole of the ring member 5, such that a phenomenon in which the ring member rides over the fusing belt 1 (hereinafter, referred to as a belt under-ride phenomenon) occurs. The deformation of the fusing belt 1 in the intersecting portion 7*b* is generated when a meandering force is approximately 1 kgf or more.

Meanwhile, to smoothly rotate the ring member 5 together with the fusing belt 1 by reducing a sliding resistance between the ring member 5 and the fusing belt 1, the ring member 5 may be formed of a fluorine resin such as polytetrafluoroethylene (PTFE) having a frictional coefficient smaller than that of a general heat resistant resin.

However, the fluorine resin is easily deformed. Therefore, the ring member 5 is easily deformed in a process of fusing the ring member 5 to the bushing 3. In the case in which the ring member 5 is mounted on the bushing 3 in a state in which it is deformed as described above, a deformed portion of the ring member 5 hinders the ring member 5 from rotating together with the fusing belt 1, such that the fusing belt 1 unstably rotates, resulting in damage to the fusing belt 1.

In addition, the hole of the ring member 5 is designed to be smaller than an outer diameter of a guide part 3*a* (see FIG. 1) of the bushing 3, to prevent the ring member coupled to the bushing 3 from being separated from the bushing. Therefore, the ring member 5 is deformed when it is coupled to the bushing 3. In the case in which the ring member 5 is coupled to the bushing in a state in which it is deformed, the edge 2 of the fusing belt 1 is damaged by the ring member 5.

Described herein is a fusing apparatus in which damage to a fusing belt and a ring member assisting in rotation of the fusing belt may be prevented, and an image forming apparatus including the same.

According to an example of the disclosure, a fusing apparatus includes: a fusing belt, a pressing roller pressed to the fusing belt to form a nib part and rotating the fusing belt, a bushing guiding an edge of the fusing belt, and a ring member rotatably coupled to the bushing and in contact with the edge of the fusing belt that rotates to rotate together with the fusing belt, wherein a first frictional force generated between the edge of the fusing belt and the ring member is larger than a second frictional force generated between the bushing and the ring member.

A sliding guide member on which one surface of the ring member is slidably supported may be disposed on a sidewall of the bushing.

The sliding guide member may have a plate shape.

The sliding guide member may be formed of a fluorine based resin or be formed of a sheet formed by coating a heat resistant resin with a fluorine based resin.

The sliding guide member may be formed of a solid lubricant.

The sliding guide member may protrude in an arc shape along the sidewall of the bushing.

The sliding guide member may protrude in at least one hemispherical shape formed integrally with the sidewall of the bushing.

The sliding guide member may have a thickness of 0.1 mm to 5 mm.

The ring member may be formed of an elastic body, and the bushing may include a supporting region in which a portion of the ring member is supported and a non-supporting region.

The non-supporting region of the bushing may be a space provided by a difference in elevation formed in the bushing.

The non-supporting region of the bushing may be depressed in a direction that becomes distant from the ring member as compared with the supporting region.

A sliding guide member on which one surface of the ring member is slidably supported may be disposed on a portion of a sidewall of the bushing, and the non-supporting region of the bushing may be a space provided by a difference in elevation formed by a thickness of the sliding guide member.

The ring member may be an elastic body of which a portion corresponding to the non-supporting region of the bushing is elastically deformed when the elastic body is pressed toward the bushing by the edge of the fusing belt.

The ring member may be formed of a heat resistant resin having elasticity.

A pair of bushings may be disposed at both ends of the fusing belt, respectively, and a pair of ring members may be coupled to the pair of bushings, respectively.

According to an example of the disclosure, a fusing apparatus includes: a fusing belt, a pressing roller pressed to the fusing belt to form a nib part and rotating the fusing belt, a ring member formed of an elastic body having one surface in contact with an edge of the fusing belt to rotate together with the fusing belt, a bushing having the ring member coupled thereto and disposed at one side of the fusing belt, and a sliding guide member disposed on a sidewall of the bushing and slidably supporting the other surface of the ring member, wherein the bushing has a difference in elevation formed so that a space in which a portion of the ring member is bent when the ring member is pressed toward the bushing by an end portion of the fusing belt is provided.

The difference in elevation may be the same as a thickness of the sliding guide member, and the thickness of the sliding guide member may be 0.1 mm to 5 mm.

The difference in elevation may be formed at a lower portion of the bushing, and may be 0.1 mm or more.

The sliding guide member may be formed of a fluorine based resin or be formed of a sheet formed by coating a heat resistant resin with a fluorine based resin.

According to an example of the disclosure, an image forming apparatus includes the fusing apparatus described above.

Hereinafter, an image forming apparatus according to an example of the disclosure will be described with reference to the drawings, and a fusing apparatus disposed in the imaging forming apparatus will be then described.

Figure 5:
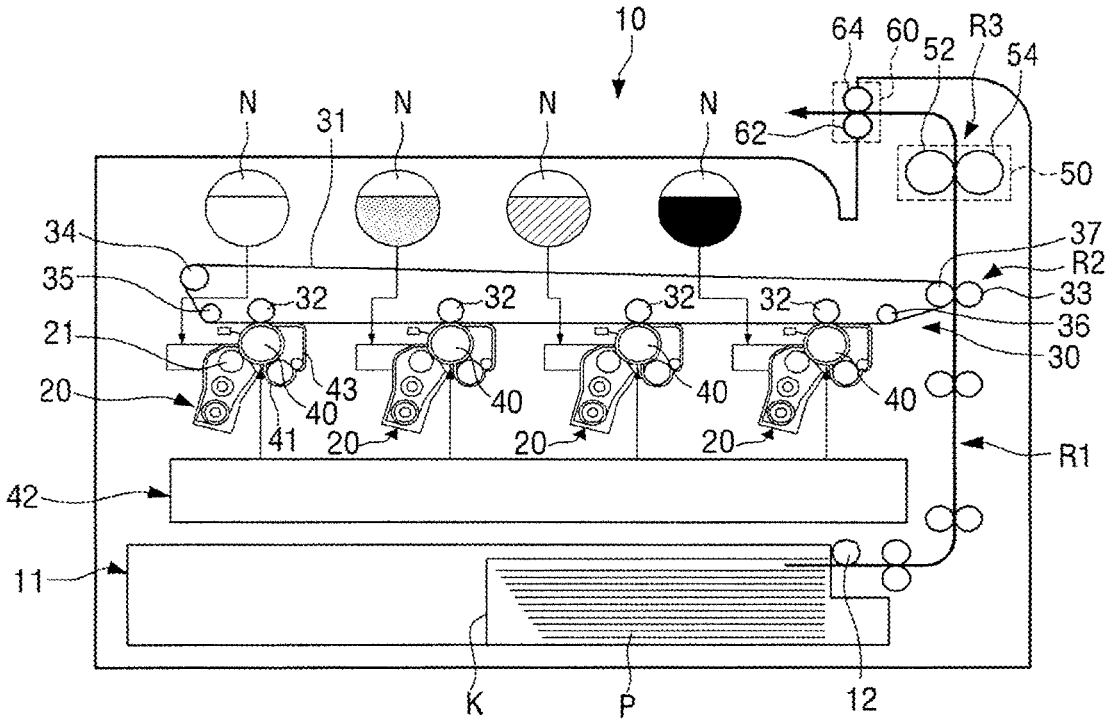
FIG. 5 is a schematic view illustrating an image forming apparatus according to an example of the disclosure.

A schematic configuration of an image forming apparatus according to an example of the disclosure will be described with reference to FIG. 5.

An image forming apparatus 10 is an apparatus of forming a color image using the respective colors such as magenta, yellow, cyan, and black. The image forming apparatus 10 includes a transport apparatus 11 transporting papers P, which are recording media, developing apparatuses 20 developing electrostatic latent images, a transfer apparatus 30 secondarily transferring toner images to the papers P, photoconductor drums 40, which are electrostatic latent image containers having images formed on circumferential surfaces thereof, a fusing apparatus 50 fusing the toner images to the papers P, and a discharge apparatus 60 discharging the papers P.

The transport apparatus 11 transports the papers P that are recording media on which images are formed, on a transport path R1. The papers P are stacked and accommodated in a cassette K, and are picked up by a paper feeding roller 12 and are transported. The transport apparatus 11 allows the paper P to arrive at a transfer nib part R2 through the transport path R1 at a timing at which the toner images transferred to the paper P arrive at the transfer nib part R2.

One developing apparatus 20 is provided for each color, such that a total of four developing apparatuses 20 may be provided. The respective developing apparatuses 20 may include developing rollers 21 containing toners in the photoconductor drums 40. The developing apparatuses 20 adjust the toners and carriers to be mixed with each other in a desired mixing ratio, further mix and agitate the toners and carriers with each other to uniformly disperse the toners, thereby adjusting developers to which an optimal charge amount is given. The developers are contained in the developing rollers 21. When the developers are transported up to regions facing the photoconductor drums 40 by rotation of the developing rollers 21, the toners in the developers contained in the developing rollers 21 moves to the electrostatic latent images formed on the circumferential surfaces of the photoconductor drums 40, and the electrostatic latent images are developed.

The transfer apparatus 30 transports the paper P to the transfer nib part R2 secondarily transferring to the toner images formed by the developing apparatuses 20 to the paper P. The transfer apparatus 30 includes a transfer belt 31 to which the toner images are primarily transferred from the photoconductor drums 40, first to fourth suspending rollers 34 to 37 suspending the transfer belt 31, primary transfer rollers 32 sandwiching the transfer belt 31 together with the photoconductor drums 40, and a secondary transfer roller 33 sandwiching the transfer belt 31 together with the fourth suspending roller 37.

The transfer belt 31 is an endless belt circulated and moved due to the first to fourth suspending rollers 34 to 37. The first to fourth suspending rollers 34 to 37 are rollers rotatable in the respective central axis directions. The fourth suspending roller 37 is a driving roller rotation-driving in a central axis direction, and the first to third suspending rollers 34 to 36 are driven rollers driven-rotated by the rotation-driving of the fourth suspending roller 37. The primary transfer rollers 32 are provided to press the photoconductor drums 40 from an inner circumferential side of the transfer belt 31. The secondary transfer roller 33 is disposed in parallel with the fourth suspending roller 37 with the transfer belt 31 interposed therebetween, and is provided to press the fourth suspending roller 37 from an outer circumferential side of the transfer belt 31. Therefore, the secondary transfer roller 33 and the transfer belt 31 form the transfer nib part R2 therebetween.

One photoconductor drum 40 is provided for each color, such that a total of four photoconductor drums 40 may be provided. The respective photoconductor drums 40 are provided in a moving direction of the transfer belt 31. The developing apparatuses 20, charge rollers 41, exposing units 42, and cleaning units 43 are provided on circumferences of the photoconductor drums 40.

The charge rollers 41 are charge means uniformly charging surfaces of the photoconductor drums 40 at a predetermined potential. The charge rollers 41 move in accordance with rotation of the photoconductor drums 40. The exposing units 42 expose the surfaces of the photoconductor drums 40 charged by the charge rollers 41 depending on images formed on the paper P. Therefore, potentials of portions exposed by the exposing units 41 on the surfaces of the photoconductor drums 40 are changed, and electrostatic latent images are formed.

The four developing apparatuses 20 develop the electrostatic latent images formed on the photoconductor drums 40 by toners supplied from toner tanks N provided to face the respective developing apparatuses 20, and generate toner images. Magenta, yellow, cyan, and black toners are charged in the respective toner tanks N, respectively. The cleaning units 43 recover toners remaining on the photoconductor drums 40 after the toner images formed on the photoconductor drums 40 are primarily transferred to the transfer belt 31.

The fusing apparatus 50 passes the paper through a fusing nib part R3 performing heating and pressing to attach and fuse the toner images secondarily transferred from the transfer belt 31 to the paper P to the paper P.

The fusing apparatus 50 may include a fusing belt 52 heating the paper P and a pressing roller 54 pressing the fusing belt 52 to rotation-drive. The fusing belt 52 is formed of a thin metal, and the pressing roller 54 is formed in a cylindrical shape and includes a shaft 55 and a heat source (a heater locally heating the fusing belt, a halogen lamp entirely heating the fusing belt, or the like) disposed therein. The fusing nib part R3, which is a contact region, is provided between the fusing belt 52 and the pressing roller 54, and the paper P passes through the fusing nip part R3, such that the toner images are fused to the paper P.

The discharge apparatus 60 includes discharge rollers 62 and 64 discharging the paper P to which the toner images are fused by the fusing apparatus 50 to the outside of the image forming apparatus 10.

Next, a printing process depending on the image forming apparatus 10 will be described. When an image signal of an image to be recorded is input to the image forming apparatus 10, a controller of the image forming apparatus 10 rotates the paper feeding roller 12 to pick up and transport the papers P stacked in the cassette K. In addition, the surfaces of the photoconductor drums 40 are uniformly charged at the predetermined potential by the charging rollers 41 on the basis of the received image signal (a charging process). Then, the electrostatic latent images are formed by irradiating laser beams to the surfaces of the photoconductor drums 40 by the exposing units 42 (an exposing process).

In the developing apparatuses 20, the electrostatic latent images are developed, such that the toner images are formed (a developing process). The toner images formed as described above are primarily transferred from the photoconductor drums 40 to the transfer belt 31 in regions at which the photoconductor drums 40 and the transfer belt 31 face each other (a transfer process). In the transfer belt 31, the toner images formed on the four photoconductor drums 40 are sequentially stacked, and one stacked toner image is formed. In addition, the stacked toner image is secondarily transferred to the paper P transported from the transport apparatus 11 in the transfer nib part R2 at which the fourth suspending roller 37 and the secondary transfer roller 33 face each other.

The paper P to which the stacked toner image is secondarily transferred is transported to the fusing apparatus 50. In addition, when the paper P passes through the fusing nib part R3, the fusing apparatus 50 heats and presses the paper P between the fusing belt 52 and the pressing roller 54 to fuse the stacked toner image to the paper P (a fusing process). Then, the paper P is discharged to the outside of the image forming apparatus 10 by the discharge rollers 62 and 64.

Hereinafter, the fusing apparatus 50 according to an example of the disclosure will be described with reference to FIGS. 6 to 9.

Figure 8:
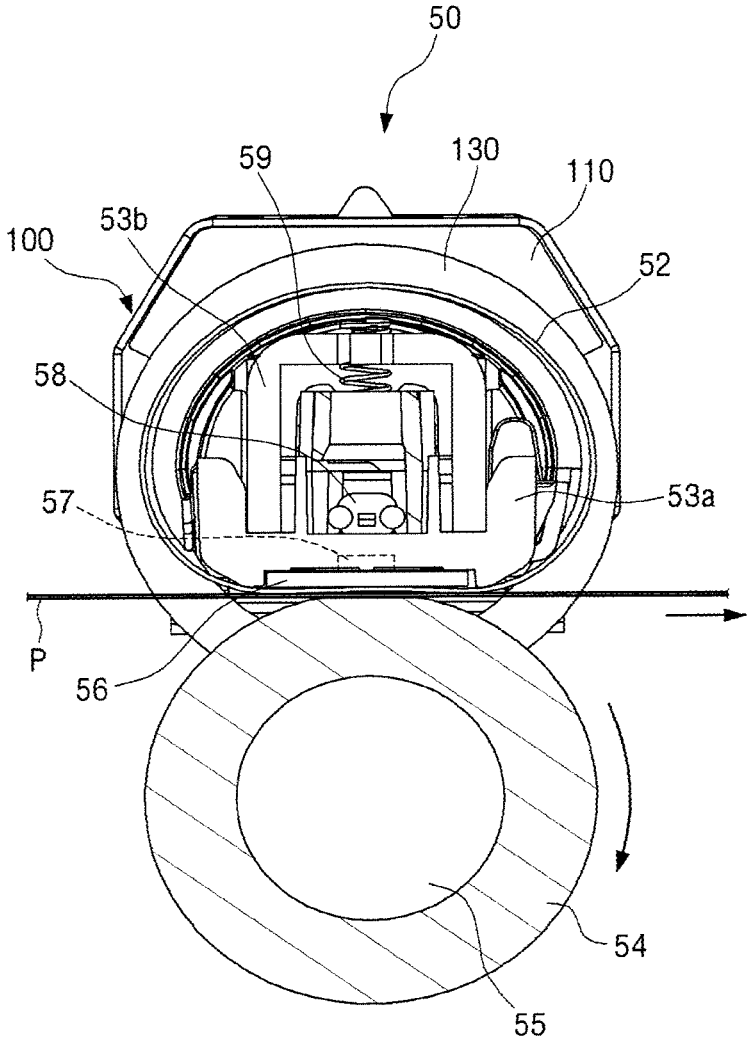
FIG. 8 is a cross-sectional view taken along line A-A of FIG. 7 and illustrating an example including a heater for locally heating the fusing belt.

Referring to FIG. 8, the fusing apparatus 50 includes the fusing belt 52 having a predetermined length, a pressing member 53*a* disposed in the fusing belt 52, a heating source 56 inserted into a lower surface of a pressing member 53*a*, the pressing roller 54 pressing the fusing belt together with the pressing member 53*a*, a temperature sensor 57 blocking the supply of power, and a thermostat 58.

The fusing belt 52 is an endless belt having a cylindrical shape, and may be mainly formed of a resin film or a metal sleeve. The fusing belt 52 may include a base layer and a release layer coated on one surface of the base layer adjacent to the pressing roller 54 or release layers coated on both surfaces of the base layer. Particularly, to improve image quality of a printed matter, an elastic layer may be disposed between the base layer and the release layer to form a relatively wide and flat fusing nib part.

The base layer of the fusing belt 52 as described above is formed of a heat resistant resin such as polyimide, polyamide, polyimideamide, or the like, or a metal such as SUS, nickel, copper, or the like, and may have a thickness of 30 to 200 μm, for example, 50 to 100 μm. The release layer (coated on a surface of the base layer) may be formed of a fluorine based resin such as perfluoroalkoxy (PFA), polytetrafluoroethylene (PTFE), fluorinated ethylene propylene (FEP), or the like, and may have a thickness of about 10 to 30 μm. The release layer is mainly formed of the fluorine based resin, and may have a thickness of 10 to 50 μm. As the fluorine based resin, the perfluoroalkoxy (PFA), the polytetrafluoroethylene (PTFE), the fluorinated ethylene propylene (FEP), or the like, may be used. As the release layer, a tube formed of the fluorine based resin may be used, and the release layer may be manufactured by a coating method using the fluorine based resin. The elastic layer may be formed of fluorine rubber, silicone rubber, or the like. In the elastic layer, a material of an insulating elastic layer may include an elastic material, for example, various rubber materials such as fluorine rubber, silicone rubber, natural rubber, isoprene rubber, butadiene rubber, nitrile rubber, chloroprene rubber, butyl rubber, acrylic rubber, hydrin rubber, and urethane rubber, or various thermoplastic elastomer materials such as styrene based, polyolefin based, polyvinyl chloride based, polyurethane based, polyester based, polyamide based, polybutadiene based, terran spore isoprene based, and chlorinated polyethylene based elastomers, or a mixture of one or two or more. Since a thickness of a second insulating layer may be smaller than that of a first insulating layer in consideration of thermal transfer to the recording medium, a thickness of the insulating elastic layer may be 10 to 100 μm.

The pressing member 53*a* is a member disposed along a length direction of an inner circumferential surface of the fusing belt 52 and pressing the pressing roller 54 through the fusing belt 52 to form an ideal fusing nib part between the fusing belt 52 and the pressing roller 54. A metal bracket 53*b* is disposed at an upper side of the pressing member 53*a*, and the heating source 56 is inserted into the lower surface of the pressing member 53*a*. The metal bracket 53*b* presses the pressing member 53*a* toward the pressing roller 54 while being pressed by bushings 100. The pressing member 53*a* may be formed of a material having a porous structure of which a heat insulation property is excellent.

The heating source 56 may locally heat the fusing belt 52 in the fusing nib part of the fusing belt 52.

The temperature sensor 57 detects a temperature of the heating source 56. When the temperature of the heating source 56 is lowered to a fusible range or less, the controller (not illustrated) of the image forming apparatus 10 supplies power to the heating source 56 to raise the temperature of the heating source 56 to the fusible range.

The thermostat 58 is disposed in the pressing member 53*a*, and blocks the supply of the power to the heating source 56 depending on a state of the fusing belt 52. The thermostat 58 has a bimetal, and blocks the supply of the power to the heating source 56 in the case in which a temperature of the bimetal is a threshold value or more.

Figure 9:
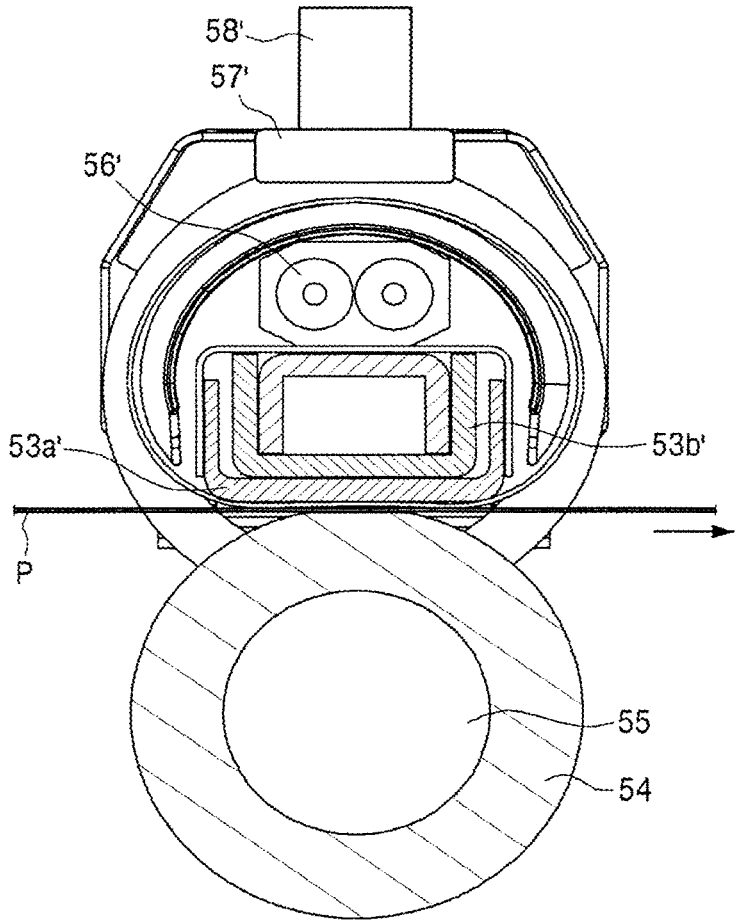
FIG. 9 is a cross-sectional view illustrating an example including a halogen lamp for entirely heating the fusing belt.

The fusing apparatus 50 according to an example of the disclosure may have a structure locally heating the fusing belt 52 as illustrated in FIG. 8, but is not limited. That is, the fusing apparatus 50 may also entirely heat the fusing belt 52 using a halogen lamp 56' as a heating source, as illustrated in FIG. 9. The halogen lamp 56' may be installed on a metal bracket 53*b*' disposed at an upper side of a pressing member 53*a*'. In this case, a temperature sensor 57' and a thermostat 58' are disposed on an outer circumferential surface of the fusing belt 52.

Figure 6:
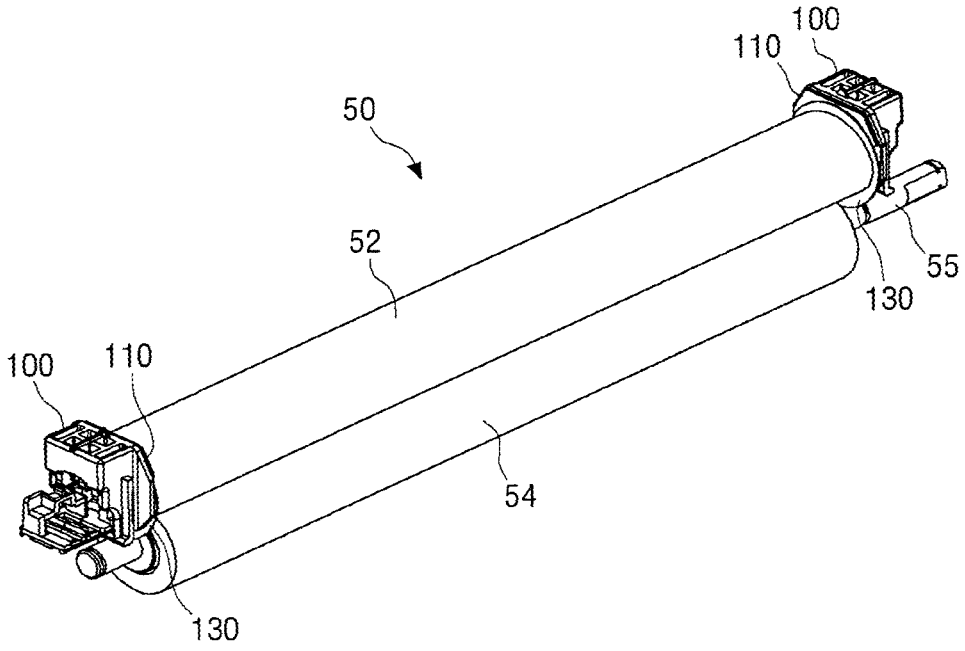
FIG. 6 is a perspective view illustrating a fusing apparatus illustrated in FIG. 5.
Figure 7:
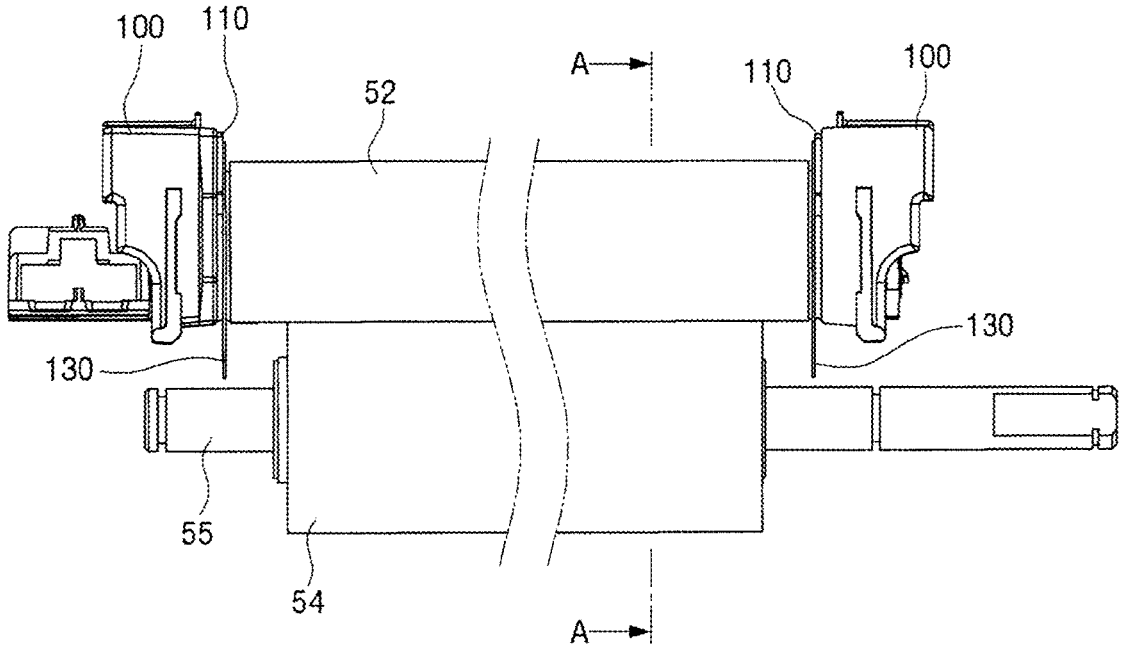
FIG. 7 is a schematic view illustrating an example in which bushings are disposed at both sides of a fusing belt, respectively, and ring members are disposed between both sides of the fusing belt and the bushings.

Referring to FIGS. 6 and 7, the bushings 100 guiding a rotation-driving of the fusing belt 52 are disposed at both ends of the fusing belt 52, respectively. The respective bushings 100 are fixed to a frame (not illustrated) disposed at an inner side of the image forming apparatus 10, and serve to press the metal bracket 53*b* positioned in the fusing belt 52 when they are disposed at both ends of the fusing belt 52, respectively. Ring members 130 are disposed in the respective bushings 100 in a state in which they are rotatable.

Since the respective bushings 100 have the same shape, one bushing 100 will hereinafter be described with reference to FIGS. 10 to 14.

Figure 10:
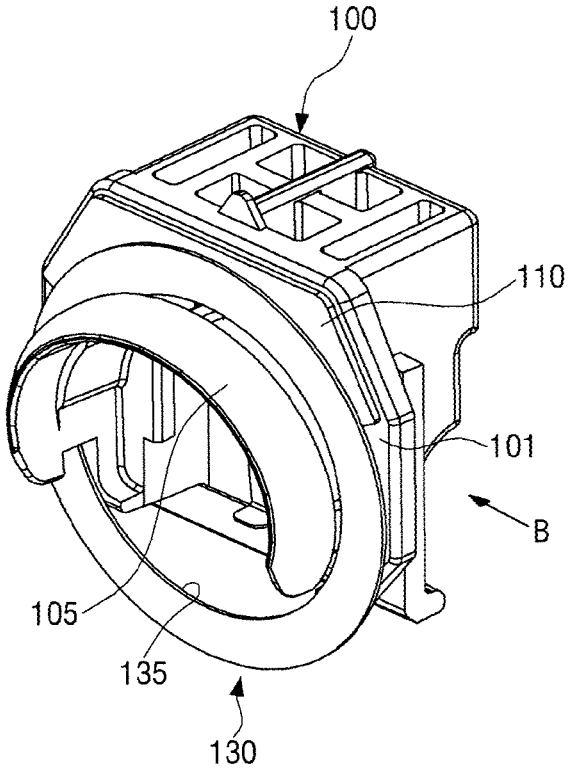
FIGS. 10 and 11 are perspective views illustrating forms before and after the ring member is coupled to the bushing, respectively.
Figure 11:
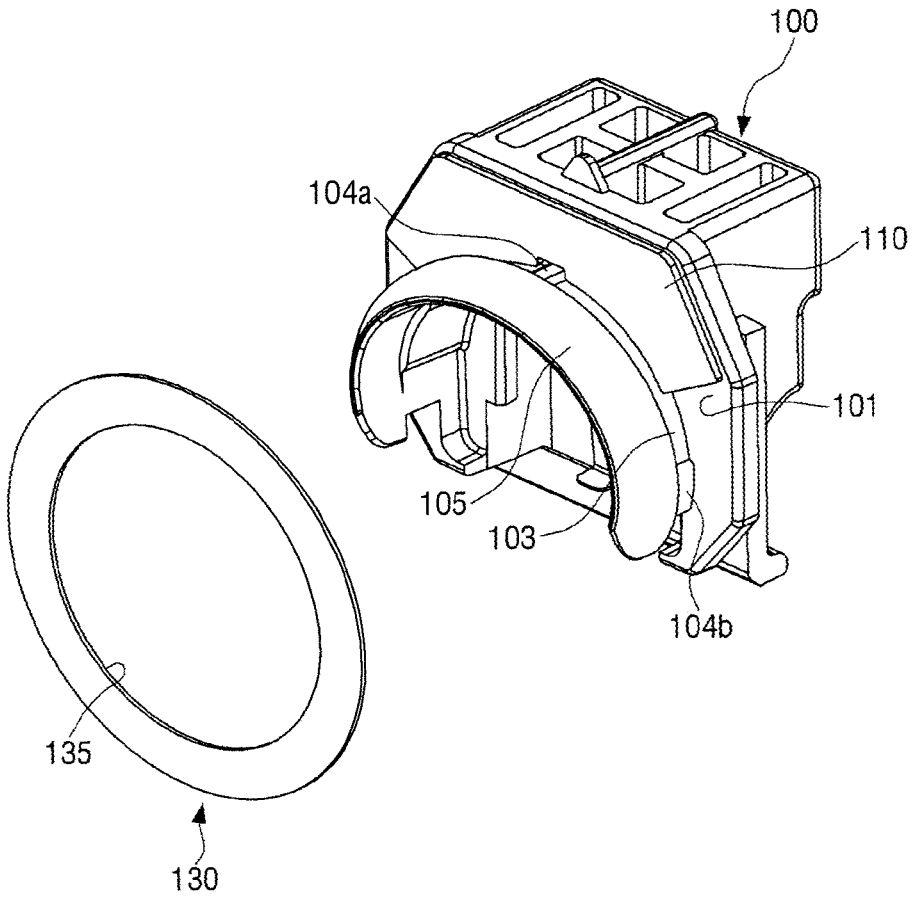

Referring to FIGS. 10 and 11, the bushing 100 includes a sidewall 101 regulating a movement of the fusing belt 52 in an axial direction and a guide part 105 formed at a front end of an extending part 103 protruding perpendicularly to the sidewall and regulating a rotation direction of the fusing belt 52.

An upper guide protrusion 104*a* and a pair of side guide protrusions 104*b* may be formed on an outer circumferential surface of the extending part 103.

The upper and side guide protrusions 104*a* and 104*b* are in contact with an inner circumferential surface of a hole 135 of the ring member 130. A contact area between the ring member 130 and the extending part 103 is minimized by the upper and side guide protrusions 104*a* and 104*b*, such that the ring member 130 may smoothly rotate together with the fusing belt 52.

The guide part 105 is formed integrally with the sidewall by the extending part 103. A diameter of the hole 135 of the ring member 130 is smaller than an outer diameter of the guide part 105 so that the ring member 130 is not separated from the bushing 100.

Therefore, when the guide part 105 passes through the hole 135 of the ring member 130, deformation of the ring member 130 is inevitable. In the example, since the ring member 130 is formed of a material having elasticity, the ring member 130 may be restored to its original shape after the guide part 105 passes through the hole 135. For example, the ring member 130 may be formed of a heat resistant resin having elasticity, such as polyethersulfone (PES), polyphenylene sulfide (PPS), liquid crystal polymer (LCP), polyimide imide (PAI), polyetheretherketone (PEEK), or the like.

Therefore, after the ring member 130 is coupled to the bushing 100, the ring member 130 is not maintained in a deformed state, but is restored to its original shape, thereby making it possible to prevent an edge 52*a* of the fusing belt 52 from being damaged by the ring member 130.

Even though meandering is generated at the time of rotation-driving of the fusing belt 52, for the ring member 130 to smoothly rotate together with the fusing belt 52, a condition in which a frictional force generated between the fusing belt 52 and the ring member 130 is larger than that generated between the bushing 100 and the ring member 130 needs to be satisfied.

In the example, the above condition may be satisfied by disposing a sliding guide member 110 between the bushing 100 and the ring member 130.

Referring to FIG. 11, the sliding guide member 110 may be attached to a portion of the sidewall 101 of the bushing 100. The sliding guide member 110 is formed to have an area smaller than that of the entire sidewall 101, and may be approximately disposed on the sidewall 101.

Figure 13:
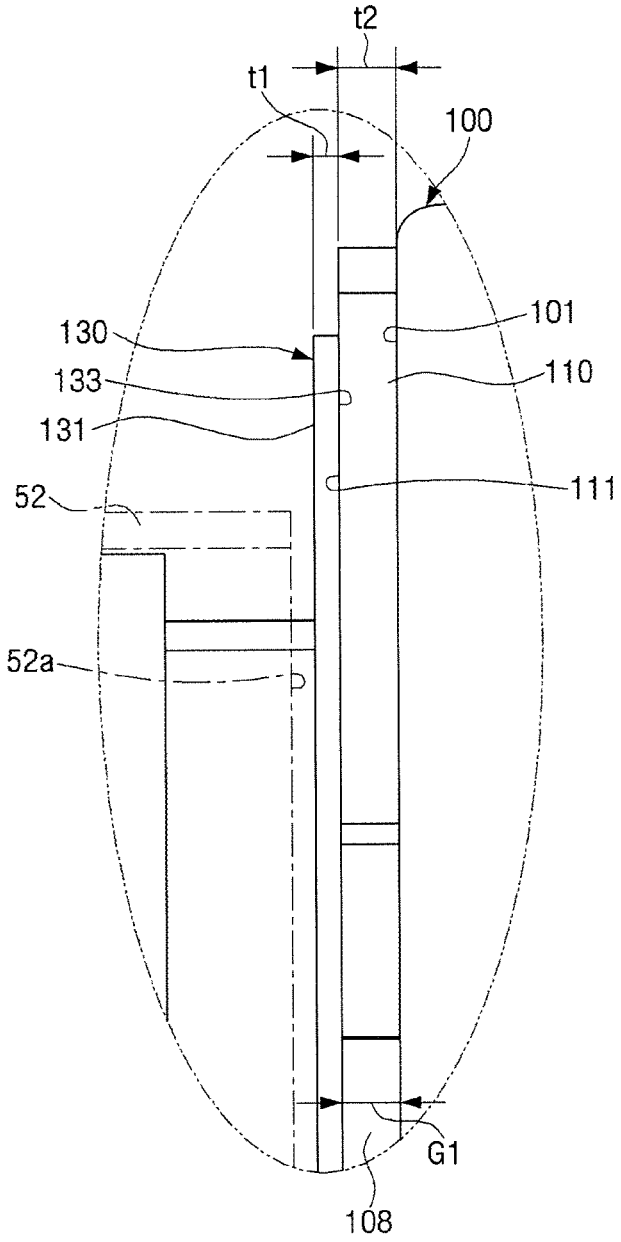
FIG. 13 is an enlarged view illustrating part D illustrated in FIG. 12.
Figure 14:
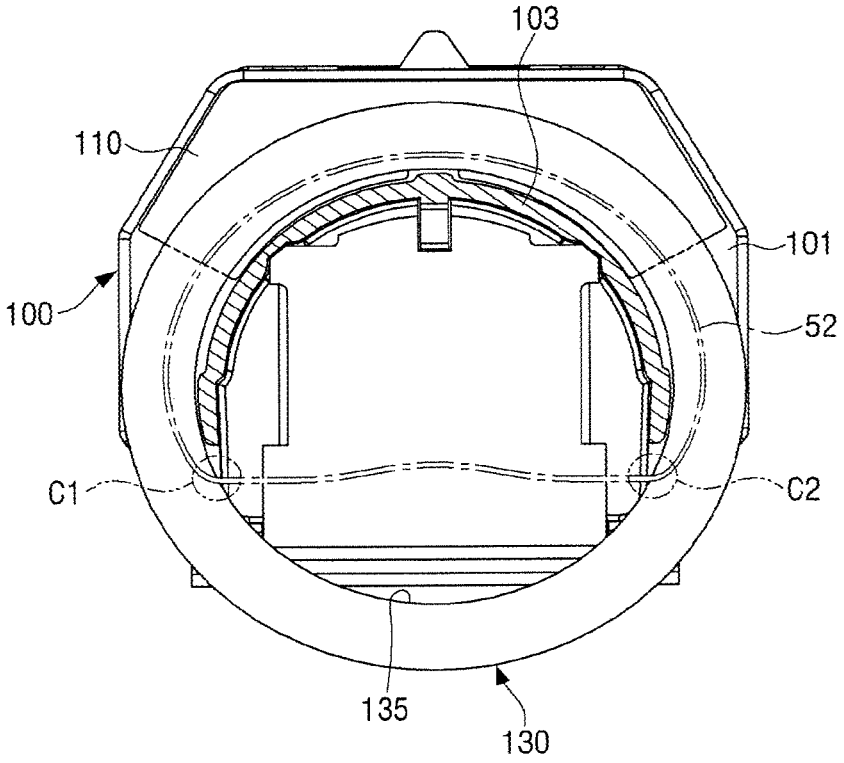
FIG. 14 is a cross-sectional view taken along line E-E of FIG. 12.

In this case, referring to FIG. 13, one surface 111 of the sliding guide member 110 may be defined as a supporting region in which the other surface 133 of the ring member 130 is slidably supported, and a region corresponding to the other portion of the sidewall 101 that is not occupied by the sliding guide member 110 in the entire sidewall 101 may be defined as a non-supporting region. In detail, the non-supporting region corresponds to a space 108 formed by a difference in elevation G1 formed between one surface 111 of the sliding guide member 110 and the sidewall 101. Two portions C1 and C2 at which the edge 52*a* of the fusing belt 52 and an inner circumferential end of the hole 135 of the ring member 130 intersect with each other are positioned in the non-supporting region.

Figure 15:
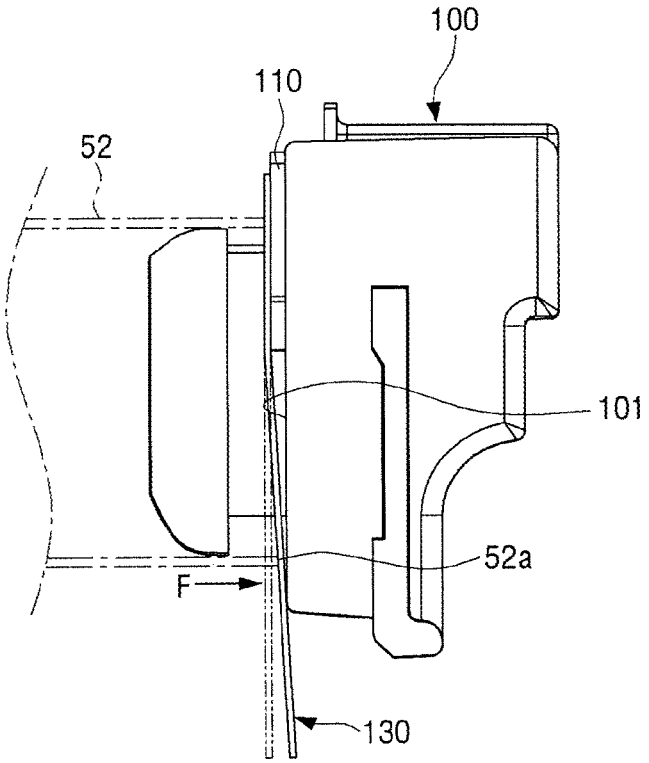
FIG. 15 is a view illustrating a state in which the ring member is pressed by an edge of the fusing belt due to meandering of the fusing belt to be thus bent toward the bushing.

Due to such a space 108, in the case in which a meandering force of the fusing belt 52 is 1 kgf or more, a portion of the ring member 130 in the non-supporting region may be bent toward the sidewall 101 when the ring member 130 is pressed by the edge of the fusing belt 52 in an arrow direction F, as illustrated in FIG. 15. When the ring member 130 is elastically bent as described above, deformation forces generated in intersection points C1 and C2 are reduced. In addition, the ring member 130 is restored to its original shape by an elastic force immediately after being deformed, the edge 52*a* of the fusing belt 52 does not go into the hole 135 of the ring member 130 along the inner circumferential end of the hole 135 of the ring member 130, but rotates together with the ring member 130. Therefore, in the example, a belt under-ride phenomenon in which the ring member 130 rides over the outer circumferential surface of the fusing belt 52 may be prevented.

Referring to FIG. 13, the difference in elevation G1 is determined by a thickness of the sliding guide member 110. The thickness t2 of the sliding guide member 110 may be 0.1 mm to 5 mm. When the thickness t2 of the sliding guide member 110 is less than 0.1 mm, the space 108 becomes narrow, such that the ring member 130 is not bent at an appropriate level and the belt under-ride phenomenon is not thus solved, and when the thickness t2 of the sliding guide member 110 exceeds 5 mm, the fusing belt 52 may be sandwiched between a pair of bushings 100, such that the fusing belt 52 does not smoothly rotate.

Meanwhile, as a result of an experiment, when a thickness t1 of the ring member 130 applied to the example is 0.3 mm to 8 mm, deformation in the intersecting portions C1 and C2 (see FIG. 14) is not generated.

The sliding guide member 110 may be formed of a fluorine based resin such as perfluoroalkoxy (PFA), polytetrafluoroethylene (PTFE), fluorinated ethylene propylene (FEP), or the like, having a low frictional coefficient so that the ring member 130 may smoothly sliding-rotate. In addition, the sliding guide member 110 may be formed of a sheet formed by coating a heat resistant resin such as polyethersulfone (PES), polyphenylene sulfide (PPS), liquid crystal polymer (LCP), polyamide imide (PAI), polyetheretherketone (PEEK), or the like, with a fluorine based resin.

Figure 16:
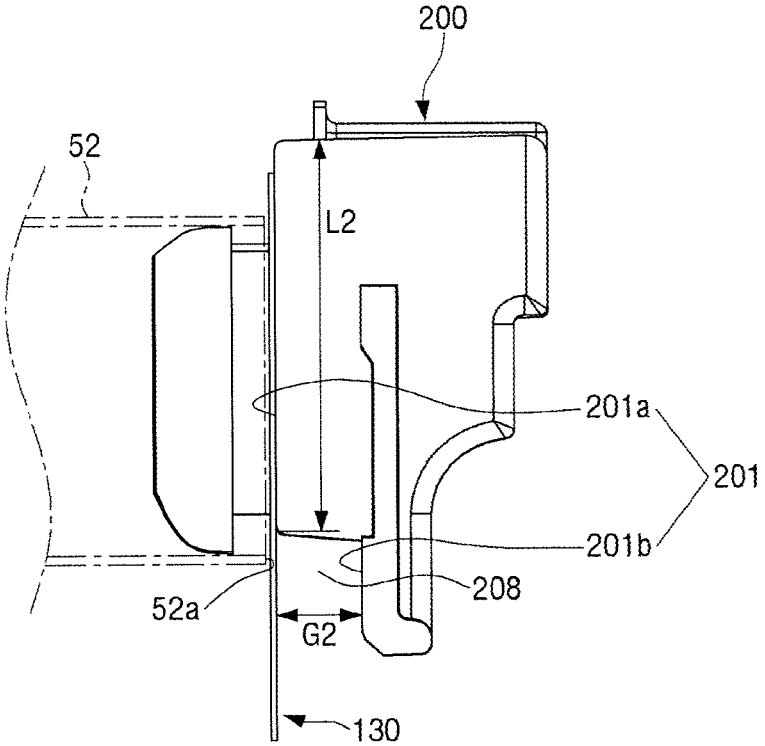
FIG. 16 is a view illustrating another example of a bushing and illustrating an example in which a difference in elevation is formed at a lower portion of the bushing.

In the above, upper and lower portions of the sidewall 101 of the bushing 100 are flush with each other without a difference in elevation. Therefore, the difference in elevation G1 is not a difference in elevation formed on the sidewall 101 itself, but is formed by the thickness of the sliding guide member 110. However, the difference in elevation is not limited thereto. That is, as illustrated in FIG. 16, a difference in elevation G2 may be formed by a height difference between an upper portion 201*a* and a lower portion 201*b* of a sidewall 201 itself of a bushing 200. In this case, the upper portion 201*a* of the sidewall 201 corresponds to the supporting region in which the ring member 130 is slidably supported, and the lower portion 201*b* of the sidewall 201 corresponds to the non-supporting region.

Figure 12:
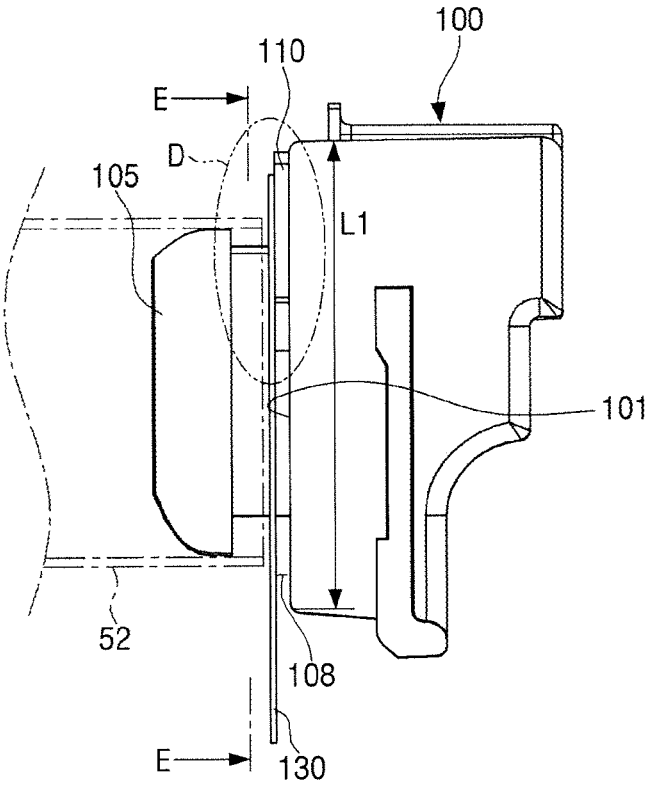
FIG. 12 is a view viewed from a direction of arrow B illustrated in FIG. 10.

A length L2 of the upper portion 201*a* of the sidewall 201 is smaller than a length L1 of the entire sidewall 101 of the bushing 100 illustrated in FIG. 12 and described above. In this case, a space 208 positioned in the non-supporting region may be formed at a level larger than or equal to the thickness of the sliding guide member 110 described above by the difference in elevation G2.

The edge 52*a* of the fusing belt 52 is positioned in the non-supporting region, as illustrated in FIG. 16. In this case, the edge 52*a* indicates a lower edge of the fusing belt 52. Therefore, in the case in which a meandering force of the fusing belt 52 is 1 kgf or more, a portion of the ring member 130 in the non-supporting region is bent toward the sidewall 201 to enter the space 208 when the ring member 130 is pressed by the edge of the fusing belt 52, thereby making it possible to prevent the belt under-ride phenomenon.

Figure 17:
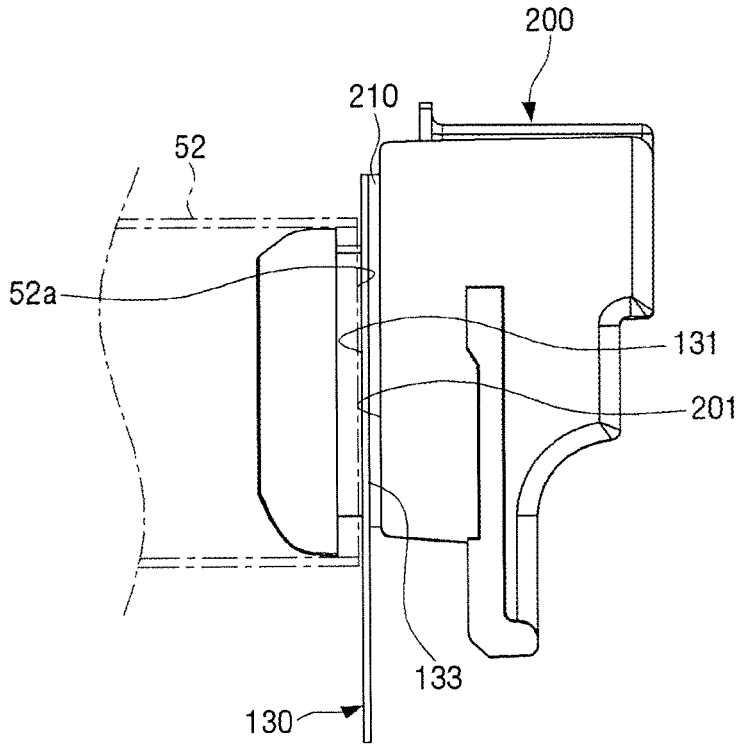
FIG. 17 is a view illustrating an example in which a lubricating layer with which a ring member is in contact is added on one surface of the bushing illustrated in FIG. 16.

In this case, a lubricating layer 210 having a predetermined thickness may be formed on the upper portion 201*a* of the sidewall 210, as illustrated in FIG. 17, to make rotation of the ring member 130 smoother. The lubricating layer 210 is applied to the entirety or a portion of the upper portion 201*a* of the sidewall 201.

The lubricating layer 210 is formed of a solid lubricant rather than a liquid-phase or gel-phase lubricant that flows. In the case in which a flowable lubricant is used, the flowable lubricant may flow along the hole 135 of the ring member 130 to be thus positioned between the edge 52*a* of the fusing belt 52 and one surface 131 of the ring member 130. In this case, a slip phenomenon is generated between the edge 52*a* of the fusing belt 52 and one surface 131 of the ring member 130 due to the lubricant, such that the ring member 130 may not perform its role. Therefore, the lubricating layer 210 may be formed of the solid lubricant.

The other surface 133 of the ring member 130 is in contact with the lubricating layer 210, and the ring member 130 may smoothly rotate together with the fusing belt 52 at the time of rotation of the fusing belt 52.

Figure 18:
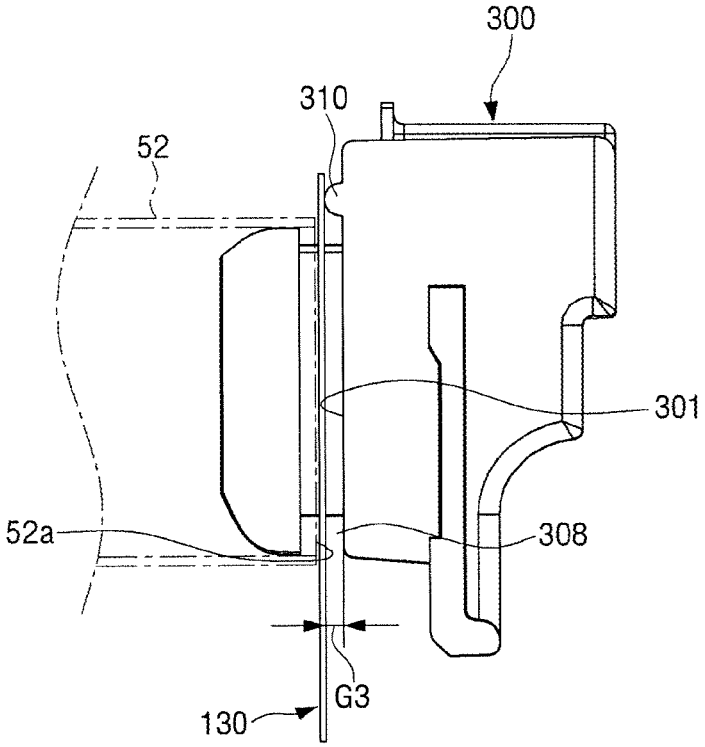
FIG. 18 is a view illustrating an example in which a guide protrusion with which a ring member is in contact is integrally formed on one surface of the bushing illustrated in FIG. 16.

Referring to FIG. 18, a bushing 300 may include a sliding protrusion 310 formed on a sidewall 301 thereof instead of the lubricating layer 210 to slidably support the ring member 130.

Figure 19A:
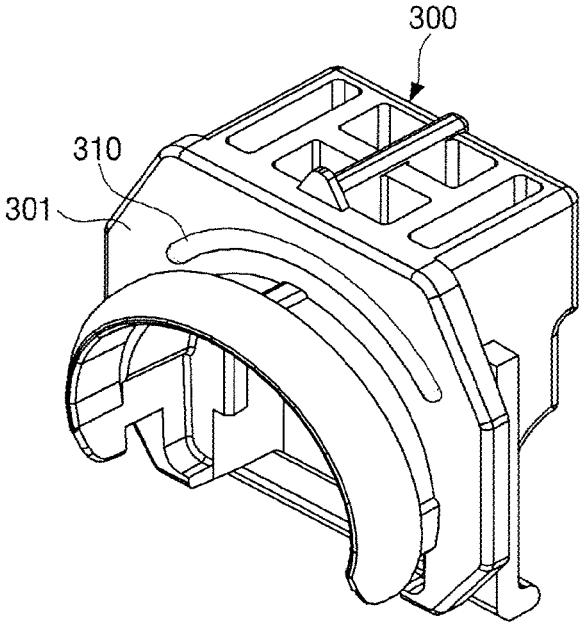
FIG. 19A is a perspective view illustrating the bushing on which the guide protrusion illustrated in FIG. 18 is formed.

The sliding protrusion 310 protrudes toward a side at which the ring member 130 is coupled, and may be formed in an approximately arc shape along the sidewall 301, as illustrated in FIG. 19A. As described above, the sliding protrusion 310 may be formed in the arc shape corresponding or similar to a rotation trajectory of the fusing belt 52. In this case, the sliding protrusion 310 may correspond to the supporting region, and a portion except for the sliding protrusion 310 may correspond to the non-supporting region.

As illustrated in FIG. 18, a difference in elevation G3 formed in the bushing 300 may be determined by a protrusion length of the sliding protrusion 310. Due to such the difference in elevation G3, in the case in which a meandering force of the fusing belt 52 is 1 kgf or more, a portion of the ring member 130 in the non-supporting region is bent toward the sidewall 301 to enter the space 308 while the ring member 130 is pressed by the edge 52*a* of the fusing belt 52, thereby making it possible to prevent the belt under-ride phenomenon.

Figure 19B:
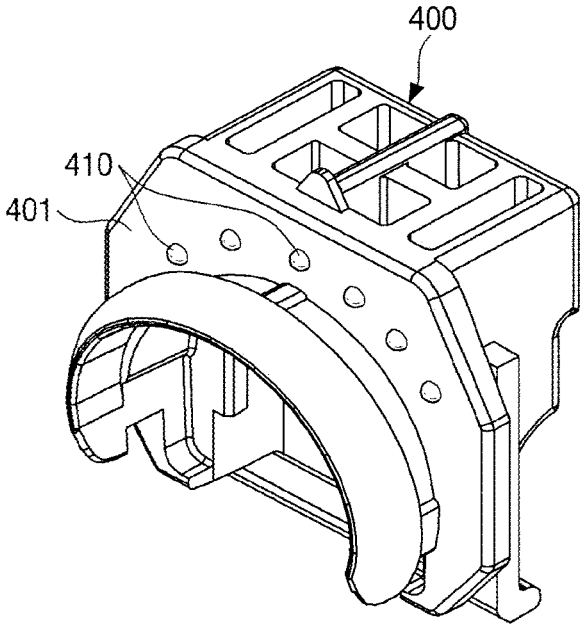
FIG. 19B is a perspective view illustrating a modified example of the guide protrusion illustrated in FIG. 19A.

Referring to FIG. 19B, sliding protrusions 410 formed on a sidewall 401 of a bushing 400 may be formed in an approximately hemispherical shape instead of the arc shape. In this case, a plurality of sliding protrusions 410 may be formed at predetermined intervals. For example, the sliding protrusions 410 may be positioned on an upper portion of the sidewall 401, similar to an attachment position of the sliding guide member 110 described above. Such a disposition is considered so that the non-supporting region is positioned below the supporting region, such that a lower portion of the ring member 130 may be bent toward the sidewall 401, as in the examples described above.

Figure 20:
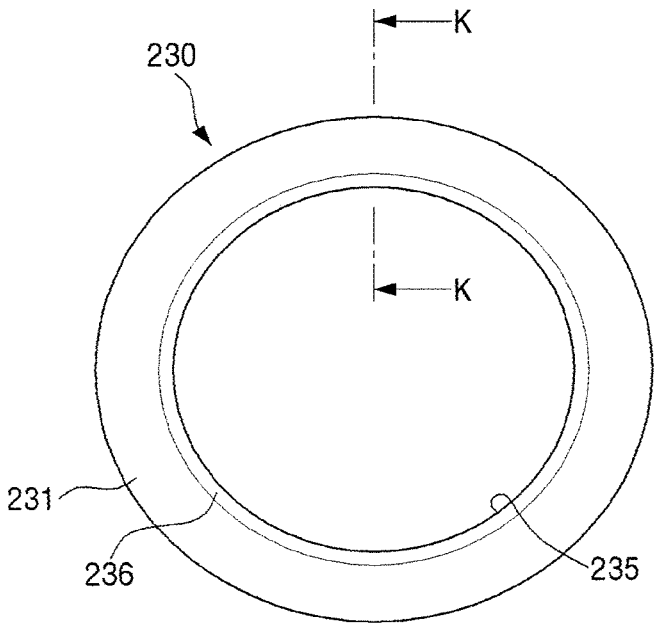
FIG. 20 is a view illustrating another example of a ring member.
Figure 21:
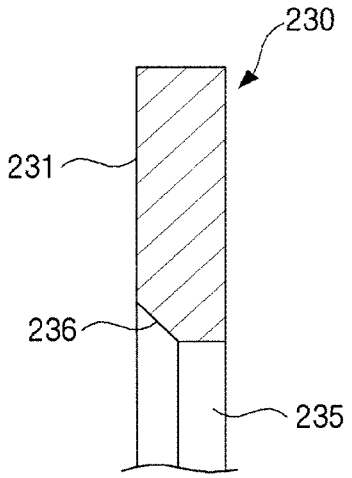
FIG. 21 is a cross-sectional view taken along line K-K of FIG. 20.

Meanwhile, the portions C1 and C2 at which the edge of the fusing belt intersects as described above are portions of the inner circumferential end of the hole 135 of the ring member 130. In this case, to reduce deformation generated in the intersecting portions C1 and C2, an inclined surface 236 may be formed along an inner circumferential end of a hole 235 of a ring member 230, as illustrated in FIGS. 20 and 21. In this case, the inclined surface 236 is formed on one surface 231 in contact with the edge 52*a* of the fusing belt 52.

Figure 22:
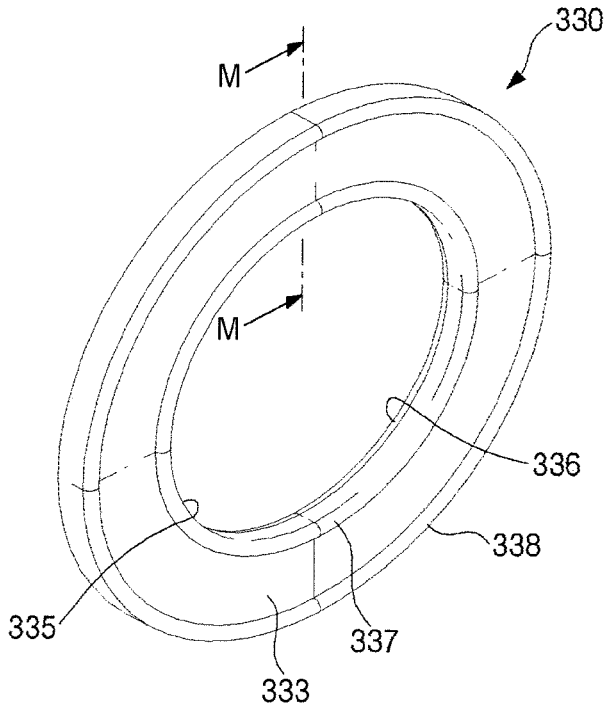
FIG. 22 is a view of another example of a ring member.
Figure 23:
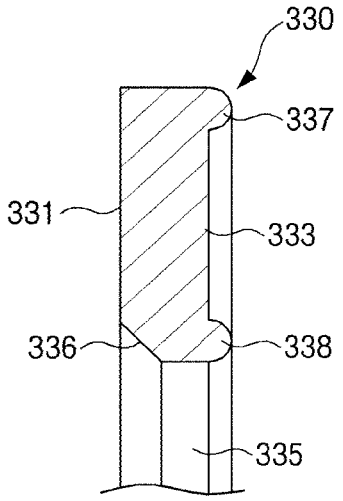
FIG. 23 is a cross-sectional view taken along line M-M of FIG. 22.

In addition, a structure slidably supporting the ring member 130 is not present on the sidewall 201 of the bushing 200 as illustrated in FIG. 16, a plurality of guide protrusions 337 and 338 are formed on the other surface 333 of a ring member 330 in contact with the sidewall of the bushing, as illustrated in FIGS. 22 and 23, to allow the ring member 330 to be smoothly slidable with respect to the sidewall 301.

One 337 of the plurality of guide protrusions 337 and 338 may be continuously formed along an outer side of the ring member 330, and the other 338 of the plurality of guide protrusions 337 and 338 may be continuously formed along a hole 335. In this case, a plurality of guide protrusions 337 may be disposed as concentric circles having different diameters.

The ring member 330 may have an inclined surface 336 formed along the hole 335 on one surface 331 thereof, like the ring member 230 described above.

In the examples of the disclosure described above, the difference in elevation is formed in the bushing. However, in other examples of the disclosure to be described below, the belt under-ride phenomenon may be prevented without forming the difference in elevation in the bushing.

Figure 24:
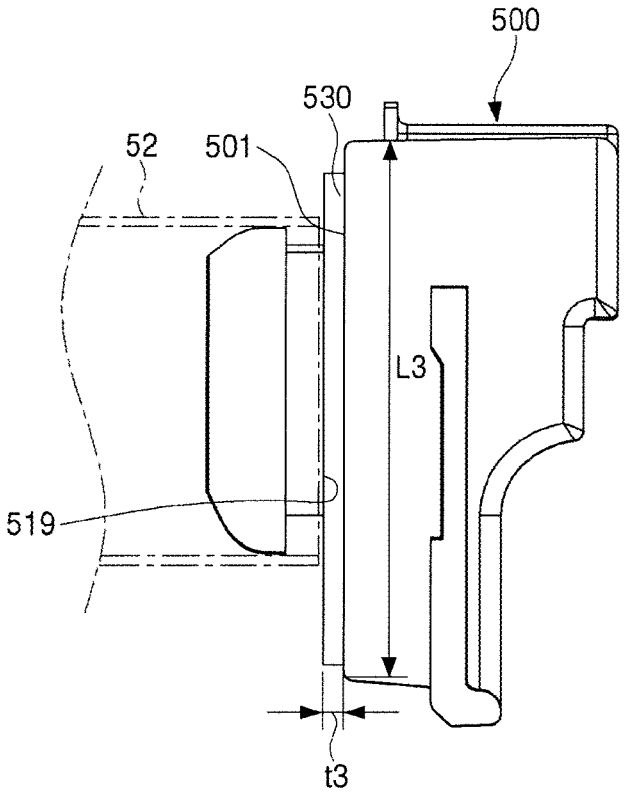
FIGS. 24 and 25 are schematic views illustrating a fusing apparatus according to an example of the disclosure.

Referring to FIG. 24, a length L3 of a sidewall 501 of a bushing 500 may be larger than or equal to the length L1 (see FIG. 12) of the bushing 100 described above. In this case, a separate difference in elevation is not formed on the sidewall 501.

A ring member 530 may be formed at a thickness t3 of 0.8 mm or more, which is larger than the thickness t1 of the ring member 130 described above. In this case, the ring member 530 may have an elastic force larger than that of the ring member 130 described above, such that even though one surface 519 of the ring member 530 is pressed by the edge 52*a* of the fusing belt 52, the ring member 530 is hardly deformed. Therefore, both of a problem in which the ring member 530 and the fusing belt 52 are deformed and the belt under-ride phenomenon may be prevented.

Figure 25:
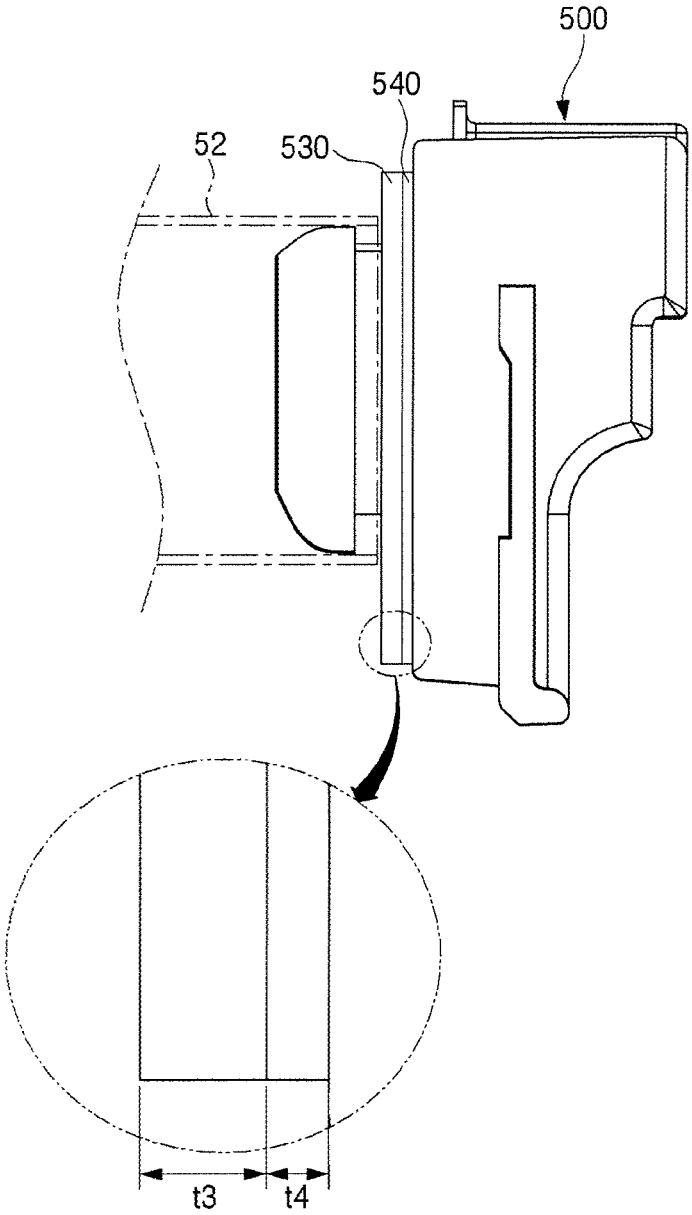

In the case in which the ring member 530 is formed at the thickness t3 of 0.8 mm or more as described above, an additional ring member 540 may be formed as illustrated in FIG. 25. In this case, the additional ring member 540 may be formed of a material having a low frictional force like the sliding guide member 110 described above to perform a lubricating action.

Although the examples of the disclosure are illustrated and described hereinabove, the disclosure is not limited to the abovementioned examples, but may be variously modified by those skilled in the art to which the disclosure pertains without departing from the scope and spirit of the disclosure claimed in the claims. These modifications should also be understood to fall within the scope of the disclosure.

What is claimed is:

1. A fusing apparatus, comprising:
- a fusing belt;
- a bushing having a sidewall that faces the fusing belt;
- a guide member, disposed on the sidewall and having a lower portion disposed above a lower portion of the sidewall; and
- a ring member, disposed between the guide member and the fusing belt, and deflectable toward the sidewall in a gap provided below the lower portion of the guide member and between the ring member and the sidewall.

2. The fusing apparatus as claimed in claim 1, wherein the guide member extends from a front end of the sidewall to a rear end of the sidewall.

3. The fusing apparatus as claimed in claim 1, wherein the guide member has an arc shape.

4. The fusing apparatus as claimed in claim 1, wherein the guide member includes a plurality of protrusions spaced apart from one another in a front to rear direction of the sidewall.

5. The fusing apparatus as claimed in claim 4, wherein the plurality of protrusions are provided at different heights along the sidewall.

6. The fusing apparatus as claimed in claim 1, wherein the guide member has a thickness of 0.1 mm to 5 mm.

7. A fusing apparatus, comprising:
- a fusing belt;
- a bushing having a sidewall that faces the fusing belt; and
- a ring member disposed between the sidewall and the fusing belt, having a diameter that is less than a height of the sidewall, and a bottom end of the ring member being in contact with the sidewall and disposed above a bottom end of the sidewall.

8. The fusing apparatus of claim 7, wherein the ring member includes a surface which faces the fusing belt and which is pressed by an edge of the fusing belt.

9. The fusing apparatus of claim 7, wherein the ring member has a thickness of at least 0.8 mm.

10. The fusing apparatus of claim 7, wherein an upper end of the ring member is in contact with an upper end of the sidewall.

11. The fusing apparatus of claim 7, further comprising a further ring member having a thickness greater than a thickness of the ring member.

12. The fusing apparatus of claim 11, wherein the further ring member is disposed between the ring member and the fusing belt.

13. The fusing apparatus of claim 11, wherein the further ring member has a same diameter as the ring member.

14. The fusing apparatus of claim 11, wherein a first frictional force generated between the edge of the fusing belt and the further ring member is larger than a second frictional force generated between the bushing and the ring member.

15. The fusing apparatus of claim 11, wherein the ring member is formed of a fluorine based resin or is formed of a sheet formed by coating a heat resistant resin with a fluorine based resin.

16. The fusing apparatus of claim 11, wherein the ring member is formed of a solid lubricant.

17. An image forming apparatus, comprising:
- a developing apparatus to develop an electrostatic latent image formed on a photoconductor to form an image;
- a transfer apparatus to transfer the image to a recording medium; and
- a fusing apparatus to fix the image to the recording medium, the fusing apparatus including:
  - a fusing belt,
  - a bushing having a sidewall that faces the fusing belt,
  - a guide member, disposed on the sidewall and having a lower portion disposed above a lower portion of the sidewall, and
  - a ring member, disposed between the guide member and the fusing belt, and deflectable toward the sidewall in a gap provided below the lower portion of the guide member and between the ring member and the sidewall.

18. The image forming apparatus of claim 17, wherein the guide member has a uniform thickness in an axial direction of the fusing belt.

19. The image forming apparatus of claim 17, wherein the gap has a uniform thickness in an axial direction of the fusing belt from the lower portion of the guide member to a lower portion of the ring member.

* * * * *